US006648804B2

(12) United States Patent
Chen

(10) Patent No.: US 6,648,804 B2
(45) Date of Patent: Nov. 18, 2003

(54) EXERCISER COMBINATION FOR VARIOUS KINDS OF EXERCISES

(76) Inventor: Ming Chin Chen, 7F, No. 46, Pin Ho 10 Street, Chang Hua (TW), 500

( * ) Notice: Subject to any disclaimer, the term of this patent is extended or adjusted under 35 U.S.C. 154(b) by 90 days.

(21) Appl. No.: 09/888,821

(22) Filed: Jun. 22, 2001

(65) Prior Publication Data

US 2002/0198081 A1 Dec. 26, 2002

(51) Int. Cl.[7] ..... A63B 21/02
(52) U.S. Cl. ..... 482/125; 482/126
(58) Field of Search ..... 482/81, 126, 122–125, 482/121, 139

(56) References Cited

U.S. PATENT DOCUMENTS 4,779,867 A * 10/1988 Hinds ..... 482/126
4,865,316 A 9/1989 Yeaman ..... 271/135
4,934,691 A * 6/1990 Rudd ..... 482/82
5,076,570 A * 12/1991 Davis ..... 482/49
5,681,248 A 10/1997 Vani ..... 482/126
5,746,687 A * 5/1998 Vial et al. ..... 482/126
5,885,196 A * 3/1999 Gvoich ..... 482/125
6,398,698 B1 * 6/2002 Hinds ..... 482/126

* cited by examiner

*Primary Examiner*—Jerome W. Donnelly
*Assistant Examiner*—Fenn C Mathew

(57) ABSTRACT

An exerciser device includes two handles attached to the ends of a cable with locking stops, a flexible and longitudinal member, and two rods secured between the longitudinal member and the handles. The users may hold and vibrate the longitudinal members to conduct rhythmic exercises or may bend the longitudinal member when the rods are disengaged from the handles. The users may hold the rods to conduct rope skipping exercises. The rods may also be disengaged from the handles and the longitudinal member and may be acted as a dumbbell.

5 Claims, 10 Drawing Sheets

EXERCISER COMBINATION FOR VARIOUS KINDS OF EXERCISES

BACKGROUND OF THE INVENTION

1. Field of the Invention

The present invention relates to an exerciser, and more particularly to am exerciser combination for conducting various kinds of exercises.

2. Description of the Prior Art

Typical exercisers may each be used for conducting one or few kinds of exercises. Foe example, U.S. Pat. No. 4,865,316 to Yeaman discloses one of the typical exercisers that may be used for training the upper muscle groups of the users. U.S. Pat. No. 5,681,248 to Vani may be used for training the abdominal portion of the user. The typical exercisers may not be used for conducting various kinds of exercises.

The present invention has arisen to mitigate and/or obviate the afore-described disadvantages of the conventional exercisers.

SUMMARY OF THE INVENTION

The primary objective of the present invention is to provide an exerciser combination for conducting various kinds of exercises.

In accordance with one aspect of the invention, there is provided an exerciser combination comprising a cable including two ends, two handles attached to the ends of the cable respectively, a flexible and longitudinal member including two ends, two rods each having a first end for securing to the ends of the longitudinal member respectively and each having a second end for securing to the handles respectively, and means for detachably securing the second ends of the rods to the handles. The rods may be disengaged from the handles, and the users may hold and wave or vibrate the longitudinal members to conduct rhythmic exercises, or may hold the rods to bend the longitudinal member. The users may hold the rods to conduct rope skipping exercises. The rods may also be disengaged from the handles and the longitudinal member and may be acted as a dumbbell.

One or more foot supports are further provided and attached onto the cable, and each includes a bottom portion having a sleeve provided thereon for threading the cable, for allowing the users to conduct weight lifting exercises.

The handles each includes a hole formed therein for receiving the ends of the cable, the exerciser combination further includes two stops engaged into the holes of the handles and engaged with the ends of the cable for securing the ends of the cable to the handles respectively.

The stops each includes at least one peripheral groove formed in an outer peripheral portion thereof for forming at least two contact points between the cable and each of the stops.

The stops each includes a semi-spherical end portion for allowing the stop to be easily engaged into the holes of the handles and to engage with the ends of the cable.

A device is further provided for detachably fastening the stops to the handles respectively and includes two wires each having a first end secured to the stops respectively, and each having a second end, and two locks secured to the second ends of the wires respectively for locking the stops to the handles respectively.

The locks each includes a lock notch formed therein for receiving the wire and for locking the wire and thus the stops to the handles respectively.

The handles each includes a U-shape having two ends, and a tube secured between the ends of each of the handles.

The ends of the handles each includes an extension extended therefrom and having a peripheral rib extended therefrom for engaging with and for locking the ends of the handles to the tube.

The detachably securing means includes two caps secured to the second ends of the rods, and two poles secured between the caps and the tubes of the handles respectively.

Two couplers are further provided and secured between the ends of the longitudinal member and the first ends of the rods respectively. The couplers each includes a first end having a shank extended therefrom and engaged into the ends of the longitudinal member respectively, and each includes a second end having a screw hole formed therein, the first ends of the rods each includes a fastener extended therefrom and threaded with the screw holes of the couplers respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
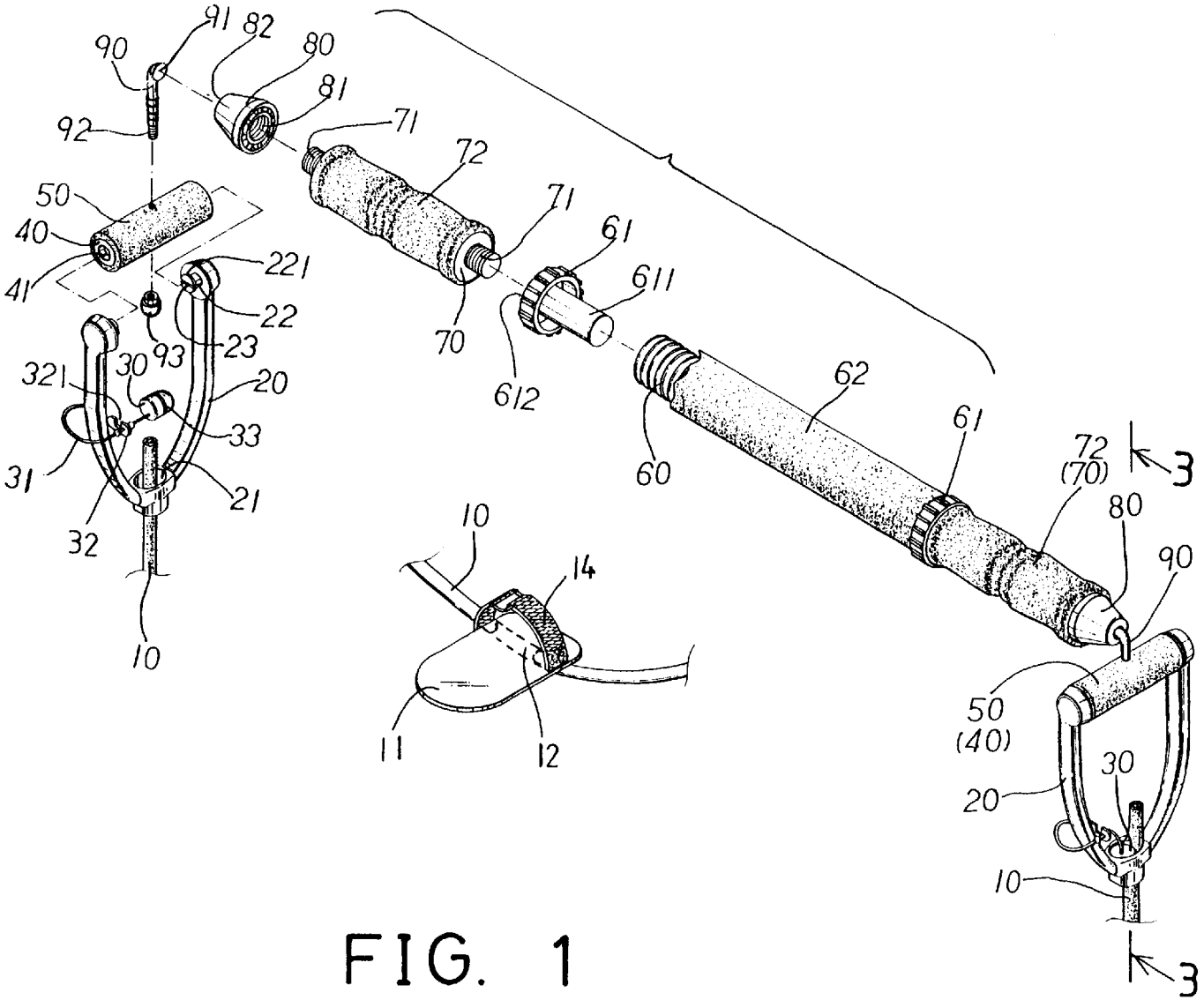
FIG. 1 is a partial exploded view of an exerciser combination in accordance with the present invention.
Figure 2:
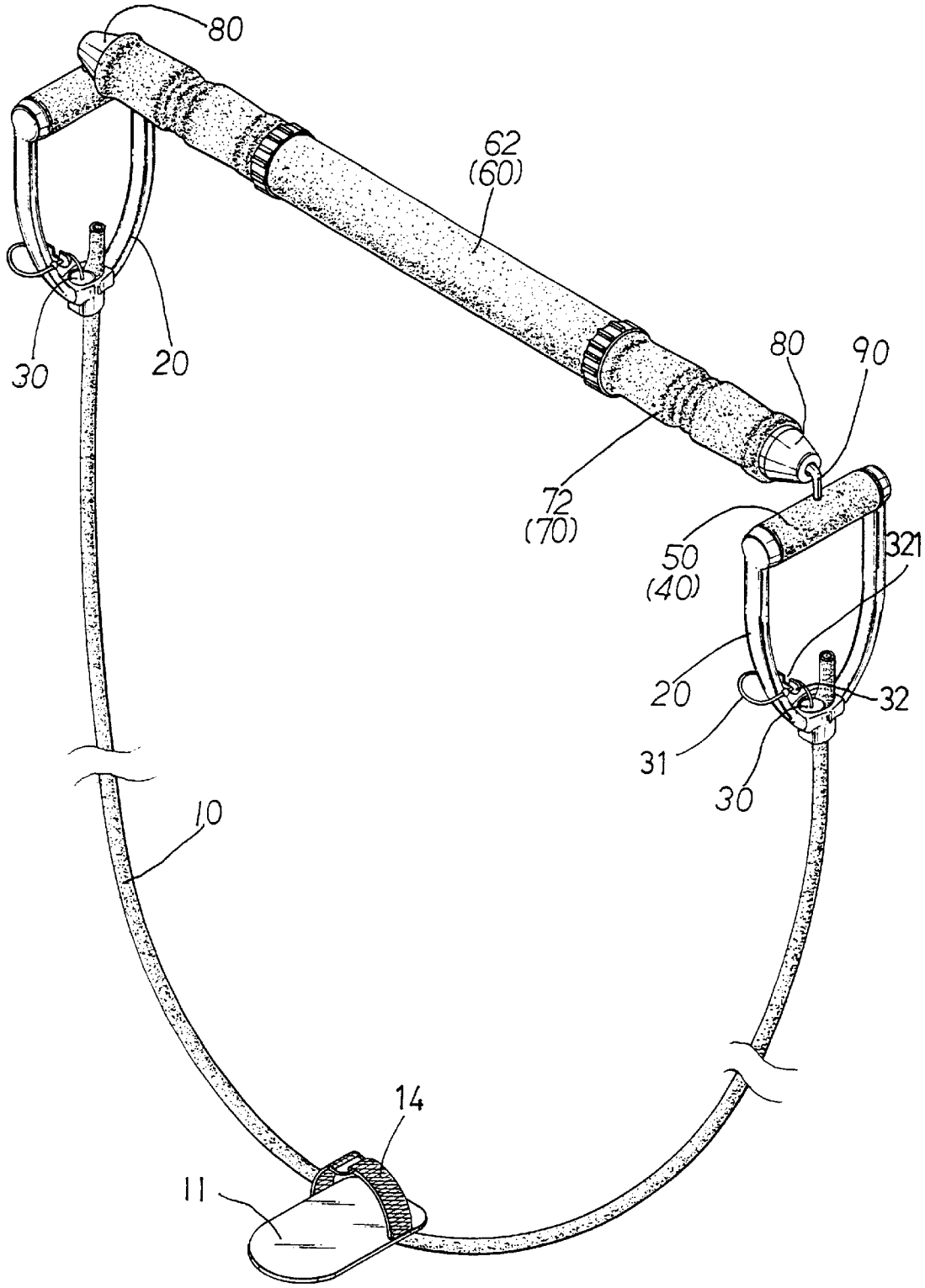
FIG. 2 is a perspective view of the exerciser combination.
Figure 4:
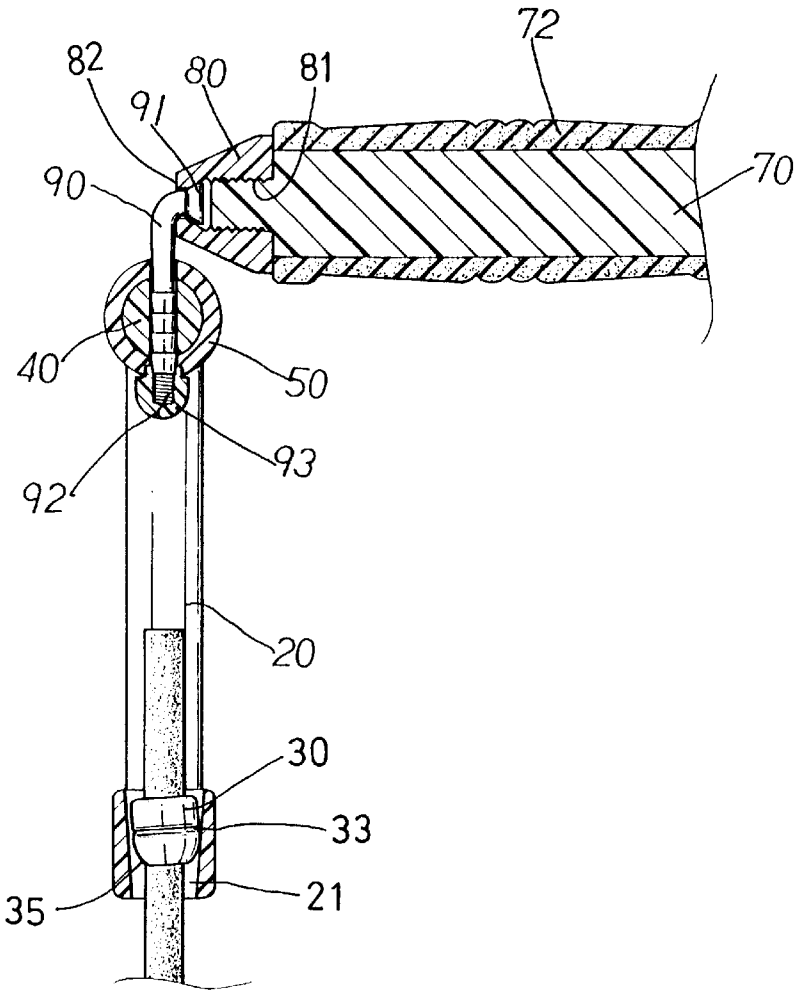
FIG. 4 is a partial cross sectional view taken along lines 4—4 of FIG. 3.

Referring to the drawings, and initially to FIGS. 1–5, an exerciser combination in accordance with the present invention comprises a longitudinal or resilient or flexible cable 10 including two ends for securing to two handles 20 respectively. One or more foot supports 11 (FIGS. 1, 2, 6) may each include a woven sleeve 12 provided or secured or stitched to the bottom of the foot supports 11 respectively for threading the cable 10 and for attaching the foot supports 11 onto the cable 10. The foot supports 11 each includes a strap 14 provided thereon for engaging with the foot of the user and for allowing the user to wear the foot supports 11.

Figure 3:
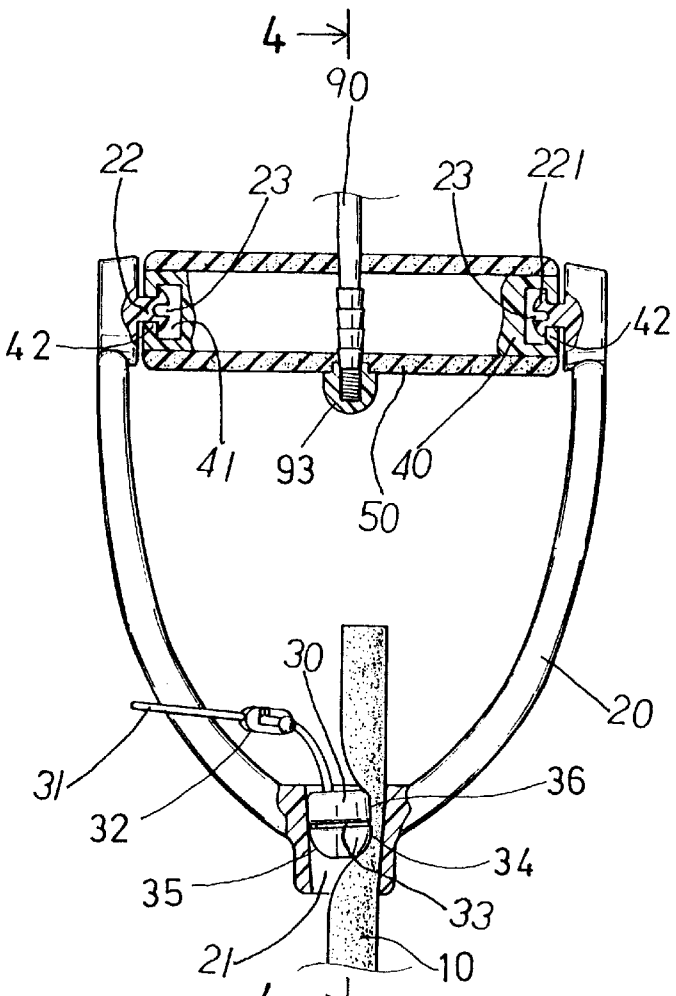
FIG. 3 is a partial cross sectional view taken along lines 3—3 of FIG. 1.

The handles 20 each includes a U-shape having two upper ends, and a hole 21 formed in the bottom portion for threading the end portions of the cable 10. Two stops 30 may be engaged into the holes 21 of the handles 20 respectively and may be engaged with the end portions of the cable 10 for detachably securing the end portions of the cable 10 to the handles 20. The stops 30 preferably include a cylindrical shape having a substantially semi-spherical end portion 35 for allowing the stop 30 to easily engage into the hole 21 of the handle 20 and to easily engage with the cable 10, and having one or more peripheral grooves 33 formed around the cylindrical outer peripheral portion thereof for allowing the stop 30 to engage with the cable 10 with two or more contact points 34, 36 (FIG. 3). The stop 30 may have at least one of the contact points 34, 36 engaged with the cable 10, in order to solidly and firmly secure the cable 10 to the handles 20. A wire 31 has one end secured to each of the stops 30 and has a lock 32 secured to the other end thereof. The lock 32 has a lock notch 321 formed therein for engaging with the wire 31 and for detachably securing the wire 31 to the handle 20 and for detachably securing the stop 30 to the handle 20.

Figure 5:
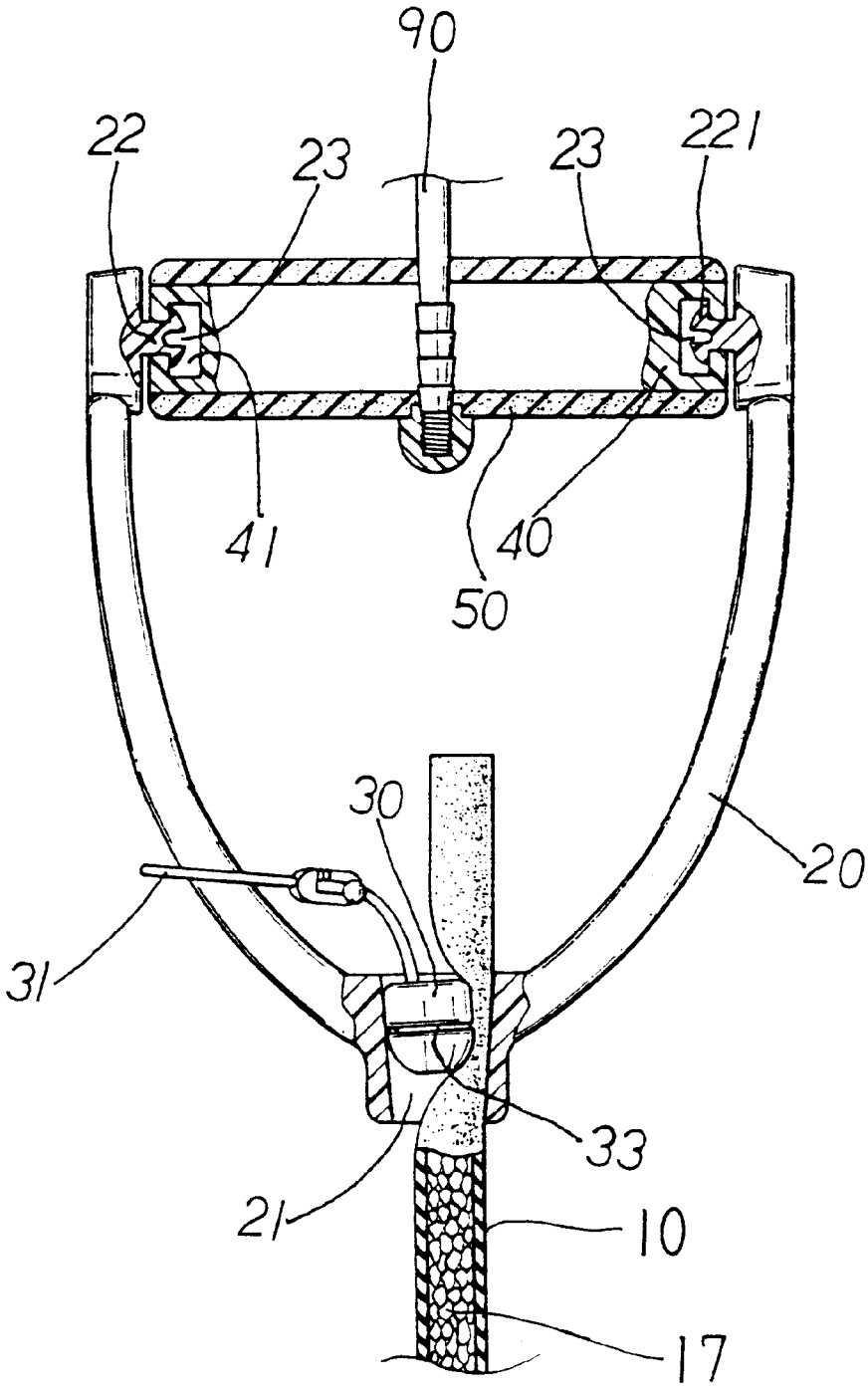
FIG. 5 is a partial cross sectional view similar to FIG. 3, illustrating the other arrangement of the exerciser combination.
Figure 8:
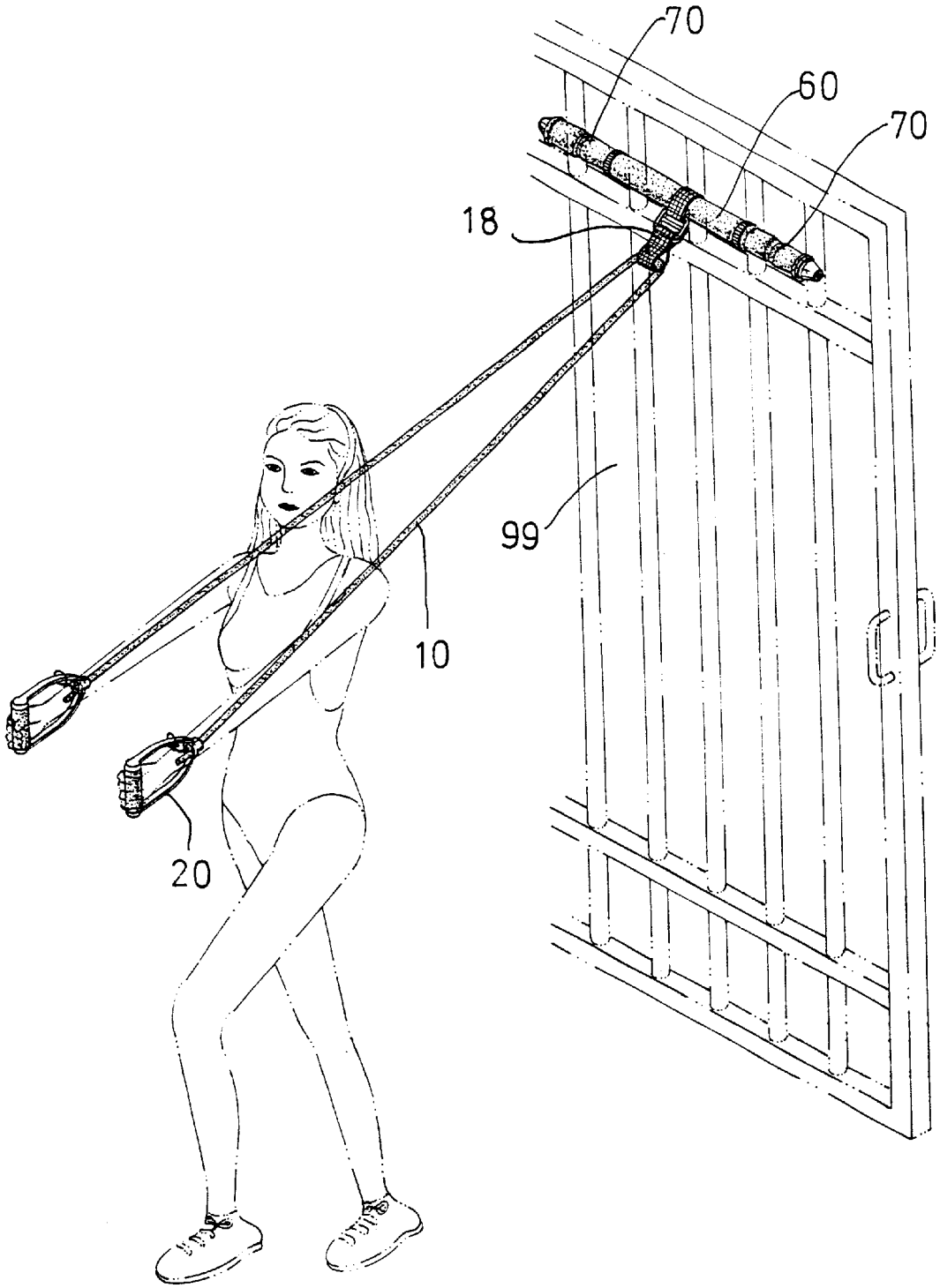
Figure 10:
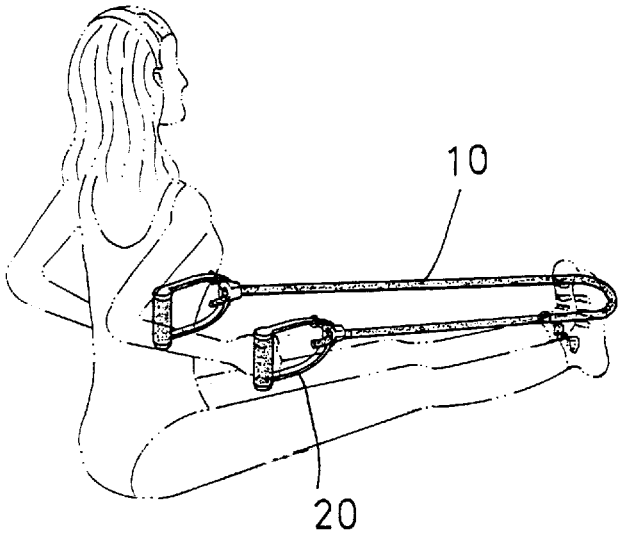
Figure 9:
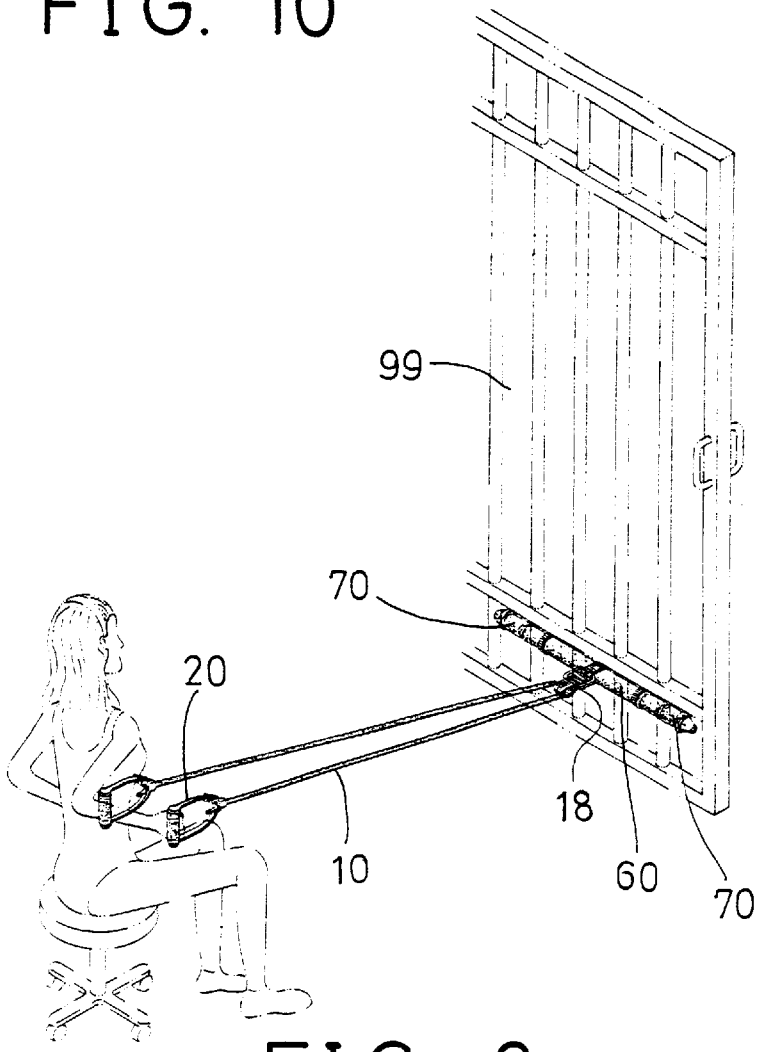

As shown in FIGS. 1, 3, 5, the handles 20 each includes two upper ends each having an extension 22 extended therefrom and each having a peripheral rib 221 and a slit 23 formed in the extension 22 respectively. A tube 40 is disposed between the upper ends of each of the handles 20, and includes two ends each having a cavity 41 formed therein for receiving the respective extensions 22 of the handles 20 and each having a peripheral flange 42 extended inward of the cavity 41 thereof for engaging with the peripheral rib 221 of the extension 22 and for locking or securing the tube 40 between the upper ends of the handle 20. A resilient or soft covering 50 may be engaged onto each of the tubes 40 for allowing the users to comfortably hold or grasp the tubes 40. As shown in FIGS. 8–10, the users may grasp the tubes 40 of the handles 20 for pulling or stretching the cable 10.

A resilient or flexible and longitudinal member 60 is further provided and may be formed with a conical or coil spring, as shown in FIG. 1. Two couplers 61 each includes a shank 611 extended therefrom and engaged into the ends of the longitudinal member 60 respectively with such as a force-fitted engagement, or with adhesive materials, or by welding processes, etc. The couplers 61 each includes a screw hole 612 formed therein for threading with a bolt or a fastener 71 of a rod 70 respectively. Two rods 70 may thus be secured to the ends of the longitudinal member 60 with the couplers 61 and the fasteners 71, and each includes two ends each having a fastener 71 secured thereto. The rods 70 are preferably made of weight materials, such as the metal or the like, for increasing the weight of the ends of the longitudinal member 60.

Figure 11:
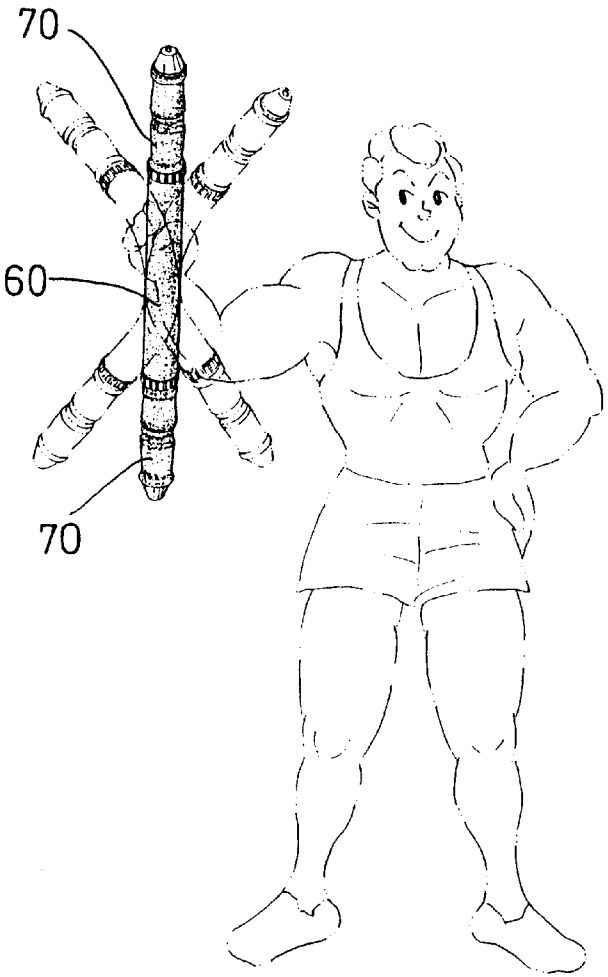
Figure 12:
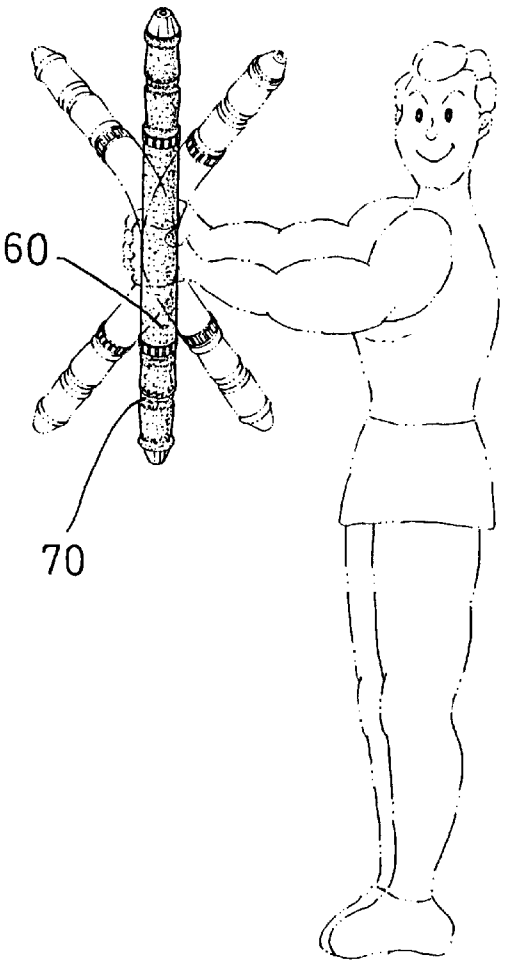
Figure 14:
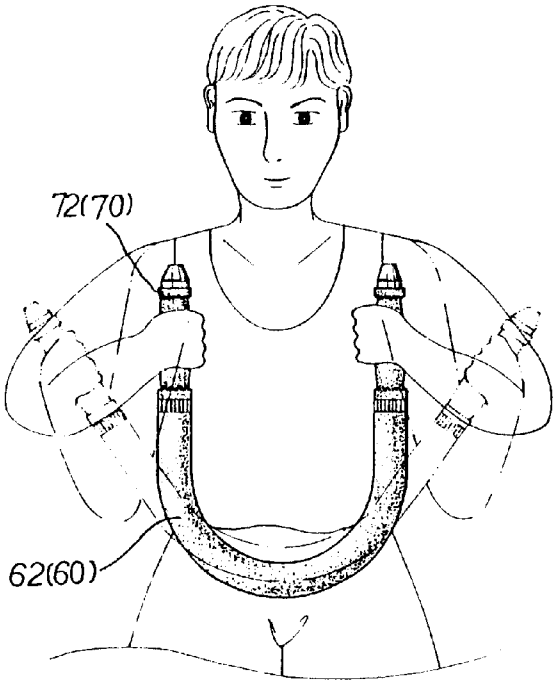
Figure 13:
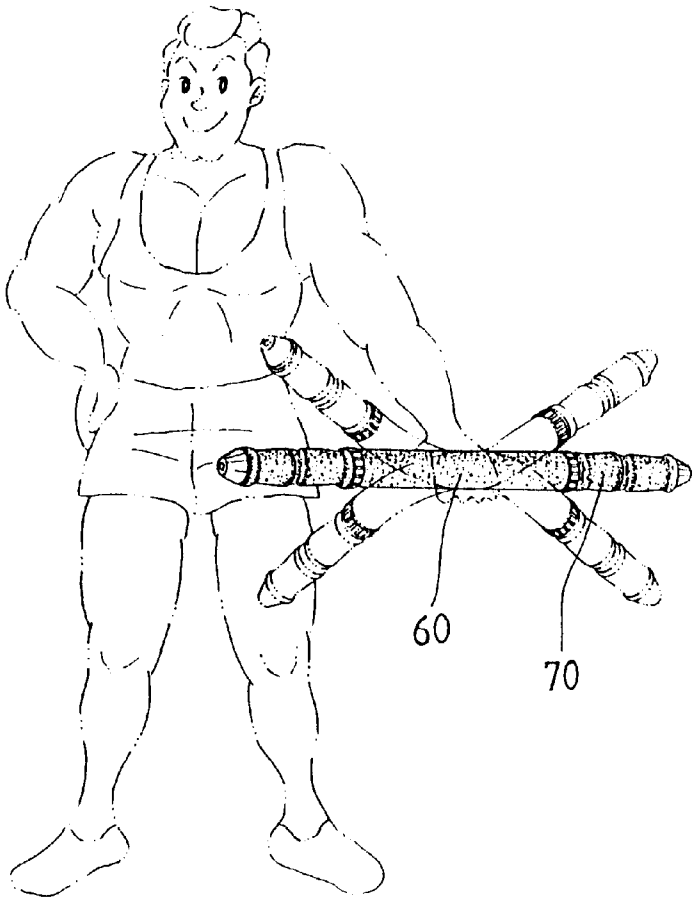
Figure 15:
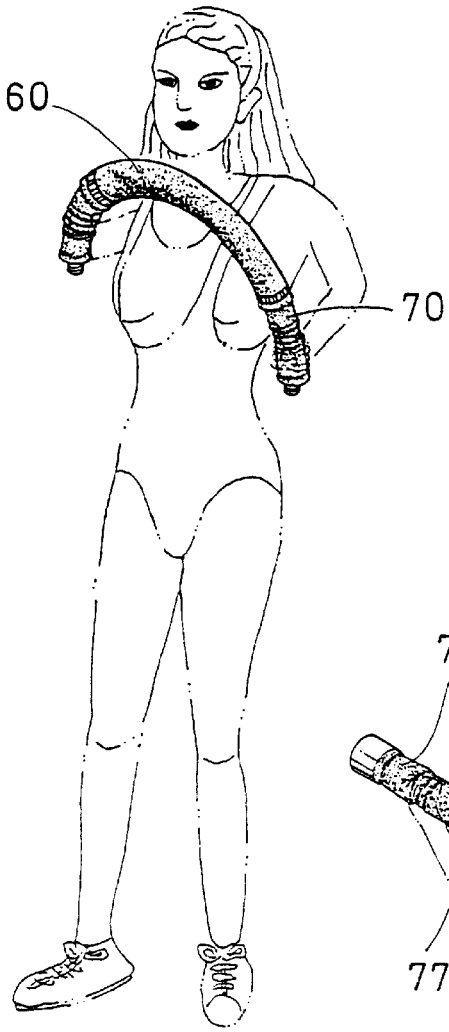
Figure 16:
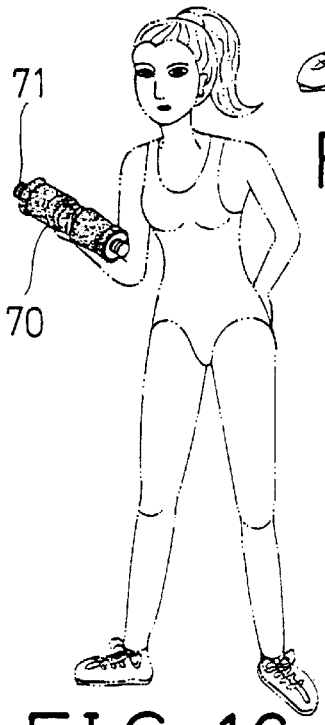
Figure 17:
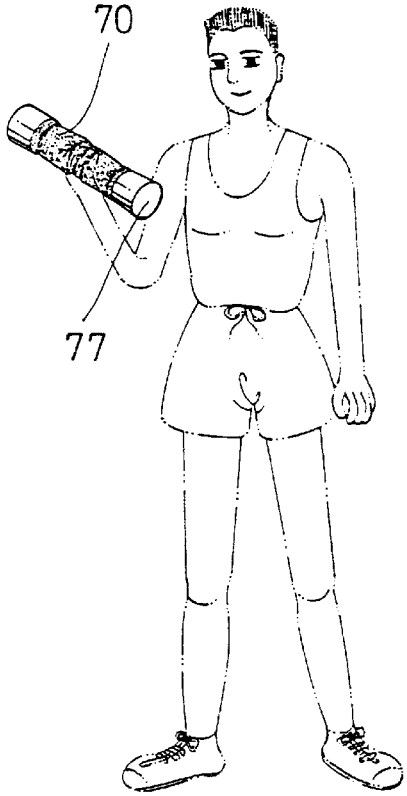

In operation, as shown in FIGS. 11–13, the users may have one or both of their hands each holding or grasping the longitudinal member 60, and may wave or vibrate the longitudinal members 60 for conducting the rhythmic exercises. As shown in FIGS. 14 and 15, the users may also hold or grasp the rods 70 and may bend the resilient and flexible longitudinal member 60 in order to train the upper muscle groups of the users. As shown in FIG. 16, the rods 70 may also be used as the typical dumbbells for training the other upper muscle groups of the users. As shown in FIG. 17, one or more additional weights 77 may further be provided and secured or threaded to the rods 70 with the fasteners 71 for increasing or adjusting the weight of the rods 70 or of the dumbbells.

Two caps 80 each includes a screw hole 81 formed in one end thereof for threading with the fasteners 71 of the rods 70 and for securing to the ends or the other ends of the rods 70 respectively. The caps 80 each includes a peripheral flange 82 extended radially inward from the other end thereof. Two poles 90 are engaged through the caps 80 respectively, and each includes an enlarged head 91 formed on one end thereof for engaging with the peripheral flanges 82 of the caps 80 and for securing to the caps 80 respectively. The poles 90 each has the other end engaged through the respective tubes 40 and secured to the tubes 40 with lock nuts 93 respectively, for securing the caps 80 and thus the rods 70 and the ends of the longitudinal member 60 to the handles 20 respectively.

Figure 6:
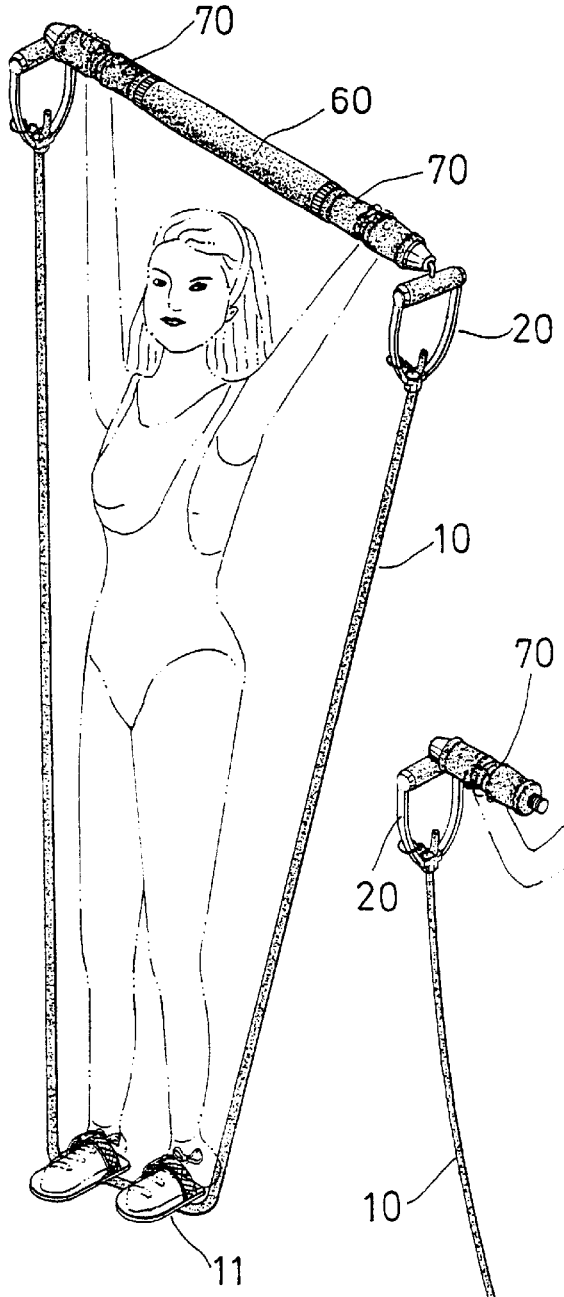
FIGS. 6, 7, 8, 9, 10, 11, 12, 13, 14, 15, 16, 17 are perspective views illustrating the operations of the exerciser combination.
Figure 7:
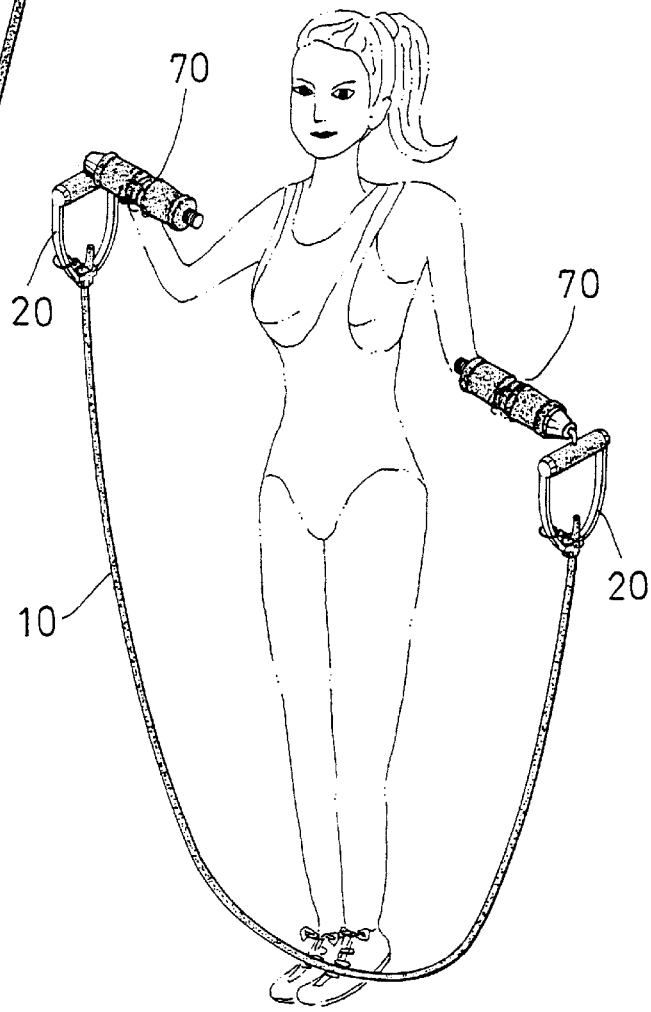

In operation, as shown in FIG. 6, the users may wear the foot supports 11, and may hold the rods 70 to stretch the cable 10 or to act as weight lifting exercises, in order to train or exercise the muscle groups of whole body. As shown in FIG. 7, the rods 70 may be disengaged from the longitudinal member 60 and may be used as the hand grips for conducting rope skipping exercises. As shown in FIGS. 8 and 9, the longitudinal member 60 and/or the rods 70 may be disengaged from the handles 20 and may be engaged with a door or frame member 99. The middle portion of the cable 10 may be secured to the longitudinal member 60 with a fastener strap 18. The users may thus hold or grasp the handles 20 to conduct various kinds of exercises.

The exerciser combination may thus be used to conduct various kinds of exercises or may be used as various kinds of exercisers, including at least the dumbbells, the skipping ropes, the weight lifting exercisers, the rhythmic exercisers, the arm bending or training exercisers, pulling exercisers, etc. The other weighed inserts, or sands, or metal particles, or the other weighed particles 17 (FIG. 5) may be engaged into the cable 10 for increasing the weight of the cable 10.

Accordingly, the exerciser combination in accordance with the present invention may be used for conducting various kinds of exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser combination comprising:

a cable including two ends, at least one foot support attached onto said cable, two handles attached to said ends of said cable respectively, said handles each including a U-shape having two ends, and a tube secured between said ends of each of said handles, a flexible and longitudinal member including two ends, two rods each having a first end for securing to said ends of said longitudinal member respectively, and each having a second end for securing to said tubes of said handles respectively, and detachably securing means for detachably securing said second ends of said rods to said handles, said detachably securing means including two caps secured to said second ends of said rods, and two poles secured between said caps and said tubes of said handles respectively.

2. The exerciser combination according to claim 1, wherein said at least one foot support includes a bottom portion haying a sleeve provided thereon to receive said cable.

3. The exerciser combination according to claim 1, wherein said ends of said handles each includes an extension extended therefrom and having a peripheral rib extended therefrom for engaging with and for locking said ends of said handles to said tube.

4. The exerciser combination according to claim 1 further comprising two couplers secured between said ends of said longitudinal member and said first ends of said rods respectively.

5. An exerciser combination comprising:

a cable including two ends, at least one foot support attached onto said cable, two handles attached to said ends of said cable respectively, said handles each including a U-shape having two ends and a tube secured between said ends of each of said handles, a flexible and longitudinal member including two ends, two rods each having a first end for securing to said ends of said longitudinal member respectively, and each having a second end for securing to said tubes of said handles respectively, two couplers secured between said ends of said longitudinal member and said first ends of said rods respectively, said couplers each including a first end having a shank extended therefrom and engaged into said ends of said longitudinal member respectively, and each including a second end having a screw hale formed therein, said first ends of said rods each including a fastener extended therefrom and threaded with said screw holes of said couplers respectively, and detachably securing means for detachably securing said second ends of said rods to said handles.

* * * * *